US012557835B2

(12) United States Patent
Caporale et al.

(10) Patent No.: US 12,557,835 B2
(45) Date of Patent: Feb. 24, 2026

(54) APPARATUS AND METHOD FOR AUTOMATICALLY FORMING CASINGS FOR SMOKING ARTICLES INCLUDING A FILTER

(71) Applicant: I.M.A. INDUSTRIA MACCHINE AUTOMATICHE S.P.A., Ozzano Dell'emilia (IT)

(72) Inventors: Antonio Caporale, Ozzano Dell'emilia (IT); Luca Galletti, Ozzano Dell'emilia (IT)

(73) Assignee: I.M.A. INDUSTRIA MACCHINE AUTOMATICHE S.P.A., Ozzano Dell'emilia (IT)

( * ) Notice: Subject to any disclaimer, the term of this patent is extended or adjusted under 35 U.S.C. 154(b) by 0 days.

(21) Appl. No.: 19/099,640

(22) PCT Filed: Jul. 26, 2023

(86) PCT No.: PCT/IT2023/050179
§ 371 (c)(1),
(2) Date: Jan. 29, 2025

(87) PCT Pub. No.: WO2024/028908
PCT Pub. Date: Feb. 8, 2024

(65) Prior Publication Data

US 2026/0041139 A1 Feb. 12, 2026

(30) Foreign Application Priority Data

Aug. 1, 2022 (IT) ..... 102022000016278

(51) Int. Cl.
*A24C 5/46* (2006.01)
*A24D 3/02* (2006.01)

(52) U.S. Cl.
CPC ..... *A24C 5/465* (2013.01); *A24D 3/0279* (2013.01)

(58) Field of Classification Search
CPC ..... A24C 5/465; A24C 5/10; A24C 5/1807; A24C 5/46; A24C 5/474; A24C 5/52; A24D 3/0279
See application file for complete search history.

(56) References Cited

U.S. PATENT DOCUMENTS

2006/0037622 A1* 2/2006 Bachmann ..... A24D 1/02 131/365
2016/0128379 A1* 5/2016 Jesperson ..... A24D 3/04 131/331

(Continued)

FOREIGN PATENT DOCUMENTS

DE 1757861 A1 * 7/1970 ..... A24C 5/465
EP 3308659 B1 3/2024

(Continued)

OTHER PUBLICATIONS

Translation of DE 1757861 A1 (Year: 1970).*
International Search Report filed in PCT/IT2023/050179 dated Oct. 30, 2023.

*Primary Examiner* — Thomas M Wittenschlaeger
(74) *Attorney, Agent, or Firm* — Rankin, Hill & Clark LLP

(57) ABSTRACT

An apparatus for automatically forming a casing for smoking articles which contains a filter includes a first forming unit configured to form the filter starting from a first shaped sheet, and a second forming unit configured to form the casing starting from a second shaped sheet. The first forming unit includes at least one first forming mandrel rotatable around a first axis of rotation thereof to form the filter, and the second forming unit includes at least one second forming mandrel to form the casing.

17 Claims, 5 Drawing Sheets

(56) References Cited

U.S. PATENT DOCUMENTS

| | | | | |
|---|---|---|---|---|
| 2020/0345062 | A1* | 11/2020 | Roth | A24C 5/42 |
| 2021/0352957 | A1* | 11/2021 | Mousson | A24D 1/022 |
| 2023/0072331 | A1* | 3/2023 | Eusepi | A24C 5/01 |
| 2023/0074403 | A1* | 3/2023 | Ghiotti | A24C 5/465 |

FOREIGN PATENT DOCUMENTS

| | | | |
|---|---|---|---|
| WO | 2021156817 | A1 | 8/2021 |
| WO | 2021156818 | A1 | 8/2021 |

* cited by examiner

APPARATUS AND METHOD FOR AUTOMATICALLY FORMING CASINGS FOR SMOKING ARTICLES INCLUDING A FILTER

FIELD OF THE INVENTION

The present invention concerns an apparatus and a method for automatically forming casings for smoking articles provided with a filter, intended to then be filled with smokable products, such as tobacco, or suchlike.

BACKGROUND OF THE INVENTION

In the field of smoking articles, there is an increasing need to make casings the size of a cigarette, guaranteeing high productivity and complete automation.

Normally, external casings for smoking articles have a substantially cylindrical or truncated cone shape and are made with non-toxic, smokable, very fragile and thin paper, with a thickness in the order of a few hundredths of a millimeter, and consequently difficult to treat mechanically.

Furthermore, in correspondence with a mouthpiece end of the casing, there is disposed a filter which is made by folding and wrapping around itself a different type of paper, not smokable, having a thickness of a few tenths of a millimeter.

In particular, an apparatus is known for forming casings by winding shaped flat elements of flexible paper material, which are overlapped around a respective forming member, called the forming mandrel, which has a substantially cylindrical or, possibly, truncated cone shape.

However, this known apparatus has the disadvantage of being excessively complex and first provides to form the casing and then to insert the filter inside it. More specifically, after being formed, the casing is transferred to a corresponding rotating member which positions it in a position for the insertion of the filter. Another disadvantage of this known apparatus is that during the transfer and transport of the casing, since it is made of a very fragile material and is manipulated by mechanical members, there is a danger that it may be damaged, in particular in correspondence with its mouthpiece end, where the filter will then be disposed.

Moreover, in the known apparatus there must be perfect alignment between the casing and the member which allows the filter to be inserted inside it, otherwise, in addition to damaging the casing itself, slowdowns and interruptions of the work cycle can be caused.

Documents WO2021/156817 A1 and WO 2021/156818 A1 describe a machine and method for producing a tubular element provided with a filter at one end. The machine provides a rotating transporter provided with at least one tubular pocket which, inside it, has a seating that reproduces the shape of the tubular element in negative and that is suitable to receive the latter. Furthermore, the machine comprises at least one transfer station, in which the tubular element is transferred inside the seating of the pocket; and an insertion station, where a filter is inserted into the corresponding tubular element, already formed and housed in the respective seating. In correspondence with the transfer station there is a tubular insertion body, in the shape of a truncated cone, which is partly introduced inside the tubular element already formed and housed in the seating, to allow the insertion of the filter by means of a thruster element. The use of several transfer and insertion means to transfer the tubular element and/or to insert the corresponding filter means that the machine is particularly complex; furthermore, inserting the filter into this machine is a very delicate operation since the tubular element, which is usually a very thin sheet of paper, is already formed and could break or get damaged during the manipulation to which it is subjected in order to allow the filter to be inserted.

There is therefore a need to perfect an apparatus for automatically forming casings containing a filter, which can overcome at least one of the disadvantages of the state of the art.

To do this it is necessary to solve the technical problem of producing the assembly defined by the filter and the casing in a fast, simple and repeatable manner, without damaging the casing and/or the filter and guaranteeing both a high final quality of the assembly obtained, and also high productivity, in the order of over 10,000 pieces/hour.

In particular, one purpose of the present invention is to provide an apparatus and perfect a method for automatically forming casings containing a filter which allows to position the filter quickly with respect to a casing, and reducing the risk of damaging the casing itself to a minimum.

Another purpose of the present invention is to provide an apparatus and perfect a method for automatically forming casings containing a filter, which are highly efficient, versatile and which allow to obtain high productivity.

Another purpose of the present invention is to provide an apparatus and perfect a method for automatically forming casings containing a filter, which can be integrated into a more complex machine, also able to perform other processes on the casings, for example for packaging finished smoking articles.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes and to resolve the technical problem disclosed above in a new and original way, also achieving considerable advantages compared to the state of the prior art, an apparatus according to the present invention for automatically forming a casing with filter for smoking articles comprises a first forming unit configured to form the filter starting from a first sheet, and a second forming unit configured to form the casing starting from a second sheet, wherein the first forming unit comprises at least one first forming mandrel rotatable around a first axis of rotation thereof to form the filter and axially mobile along the first axis of rotation, the first forming mandrel being provided with holding means to hold at least a first part of the first sheet, and wherein the second forming unit comprises at least one second forming mandrel configured to be wrapped on an external surface thereof by the second sheet so as to create the casing.

In accordance with one aspect of the present invention, the second forming mandrel is provided internally with a through axial cavity. Moreover, the at least one first forming mandrel is configured to push the filter along the through axial cavity by means of a roto-translational movement around and along the first axis of rotation when the second forming mandrel, with the second sheet wrapped on its external surface, is aligned with the first forming mandrel along a common axis of insertion.

In accordance with another aspect of the present invention, the first forming unit comprises at least one abutment element disposed coaxially to the first axis of rotation in a fixed axial position with respect to the first forming mandrel and operatively associated with the holding means.

In accordance with another aspect of the present invention, the abutment element comprises both a through cylindrical cavity, coaxial to the first axis of rotation and in which the holding means and at least the first part of the first sheet are able to be inserted, and also a lateral slit, tangent to the cylindrical cavity, to allow the passage of a second flat part of the first sheet.

In accordance with another aspect of the present invention, the second forming mandrel has a substantially truncated cone shape or surface.

In accordance with another aspect of the present invention, the first forming unit comprises first movement means configured to move the at least one first forming mandrel both around and along its first axis of rotation, and also along a first processing path which comprises at least a first forming zone of the filter and a transfer zone of the filter, distant from the first forming zone.

In accordance with another aspect of the present invention, the first movement means comprise at least a first rotating member which is rotatable around a first main axis of rotation, parallel to the first axis of rotation, the first processing path being substantially a circumference arc coaxial to the first main axis of rotation and having a first radius.

Moreover, the first rotating member is provided with at least a first peripheral through hole, in correspondence with which the at least one abutment element is mounted so that the cylindrical cavity is coaxial to the through hole.

Preferably, the first forming unit comprises one or more first forming mandrels, one or more abutment elements and one or more first through holes, operatively associated with each other.

In accordance with another aspect of the present invention, the second forming unit comprises second movement means configured to move the at least one second forming mandrel at least along a second processing path which comprises at least an insertion zone of the filter into the through axial cavity and an extraction zone of the casing including the filter from the second forming mandrel.

In accordance with another aspect of the present invention, the second movement means comprise a second rotating member which is rotatable around a second main axis of rotation parallel to the first main axis of rotation, the second processing path being substantially a circumference arc coaxial to the second main axis of rotation and having a second radius. Moreover, the first and second processing path, in correspondence with the transfer and insertion zone, respectively, are tangent to the common axis of insertion, which is parallel to the first and second main axis of rotation and along which the first and second forming mandrels are temporarily aligned with each other.

In accordance with another aspect of the present invention, the at least one second forming mandrel comprises respective elastic and flexible holding means configured to elastically hold the filter when it is inserted in the cavity in correspondence with a first end.

Preferably, the second forming unit comprises one or more second forming mandrels, operatively associated at least with respective first forming mandrels.

Furthermore, the cavity comprises an inlet aperture for inserting the filter, and an outlet aperture, opposite to the inlet aperture and associated with the first end, to allow the extraction of the filter, together with the casing.

In accordance with another aspect of the present invention, the first end is shaped in such a way as to have two or more elastic and flexible foils to elastically hold the filter when it is inserted in the cavity.

In accordance with another aspect of the present invention, the first end is provided with at least two slots made on corresponding foils in diametrically opposite positions and connected to the outlet aperture, wherein the at least two slots have the function of leaving two corresponding parts of the filter exposed to allow its extraction.

In accordance with another aspect of the present invention, the second forming unit comprises an abutment member configured to cooperate selectively with the respective holding means, both in order to define an axial end-of-travel point for the filter in the cavity, and also to limit the expansion of the respective holding means, which for example are configured as the elastic and flexible foils in accordance with some embodiments provided here, when the filter is inserted in the through axial cavity.

In accordance with another aspect of the present invention, the second forming unit also comprises an extraction device shaped and configured to contact the casing by gripping the filter, so as to extract from the second forming mandrel the casing including the filter by means of a translational movement along an axis of extraction.

In accordance with another aspect of the present invention, the second forming unit also comprises at least one holding member configured to temporarily hold the second sheet against the external surface of the second forming mandrel.

The present invention also concerns a method for forming a casing with a filter for smoking articles, the method comprising the steps of:

- forming the filter starting from a first sheet by means of at least one first forming mandrel rotatable around a first axis of rotation thereof;
- holding, by means of holding means, at least a first part of the first sheet on the first forming mandrel; and
- wrapping a second sheet around an external surface of at least one second forming mandrel, so as to create the casing.

In accordance with another aspect of the present invention, the method also comprises the steps of:

- positioning the first forming mandrel with the filter held by the holding means, and the second forming mandrel with the second sheet wrapped on its external surface, in alignment with each other along a common axis of insertion;
- pushing, by means of the first forming mandrel, the filter along a through axial cavity created inside the second forming mandrel, performing a roto-translational movement around and along the first axis of rotation.

In accordance with another aspect of the present invention, in the step of forming the filter the at least one first forming mandrel cooperates with a corresponding abutment element, which is in a fixed axial position, in order to form the filter, wherein the at least one first forming mandrel, by means of the holding means, holds the first part in a cylindrical cavity of the abutment element, while a second part of the first sheet is disposed in a lateral slit of the abutment element, and wherein the at least one first forming mandrel, by rotating around the first axis of rotation, cooperates with the cylindrical cavity in order to wrap the second part around the first part, thus forming the filter before pushing it into the through axial cavity.

In accordance with another aspect of the present invention, the step of pushing the filter comprises the following operating sub-steps:

- a first translation sub-step, in which the first forming mandrel, from a first operating position, advances along the axis of insertion with a first speed and enters the through axial cavity in order to reach a second operating position;
- a first insertion sub-step, in which, during the advance, the first forming mandrel rotates around its first axis of rotation in a first direction of rotation, giving the filter a helical movement in order to facilitate its insertion inside the through axial cavity;
- a second insertion sub-step, in which the first forming mandrel, before reaching the second operating position, reverses the direction of rotation; and
- a second translation sub-step, in which the first forming mandrel, from the second operating position, moves back along the axis of insertion with a second speed, greater than the first speed, in order to return to the first operating position.

In accordance with another aspect of the present invention, the method comprises a step of extracting both the casing and also the filter from the second forming mandrel by means of a translational movement, along an axis of extraction, of an extraction device.

In accordance with another aspect of the present invention, in the step of pushing the filter, the latter is pushed by the first forming mandrel until it partly comes out of a first end of the second forming mandrel, and without making it come out of the casing.

DESCRIPTION OF THE DRAWINGS

These and other aspects, characteristics and advantages of the present invention will become apparent from the following description of some embodiments, given as a non-restrictive example with reference to the attached drawings wherein.

Figure 3:
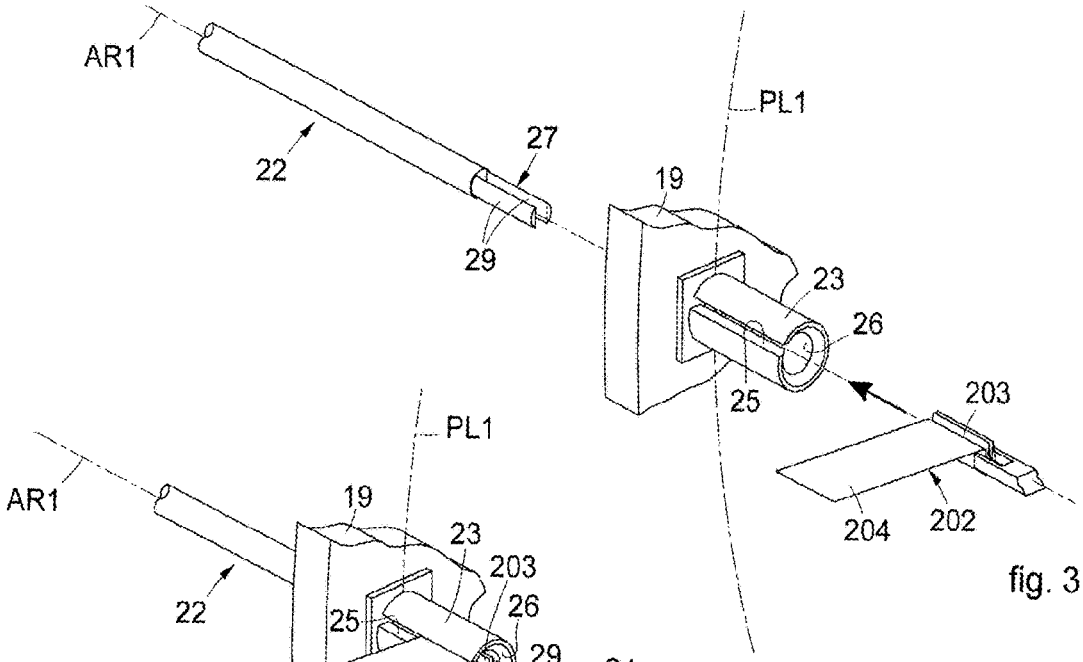
FIG. 3 is an enlarged, perspective and exploded view of a detail of a first forming unit of the apparatus of FIG. 1, in which a first forming mandrel for forming the filter is shown.
Figure 7:
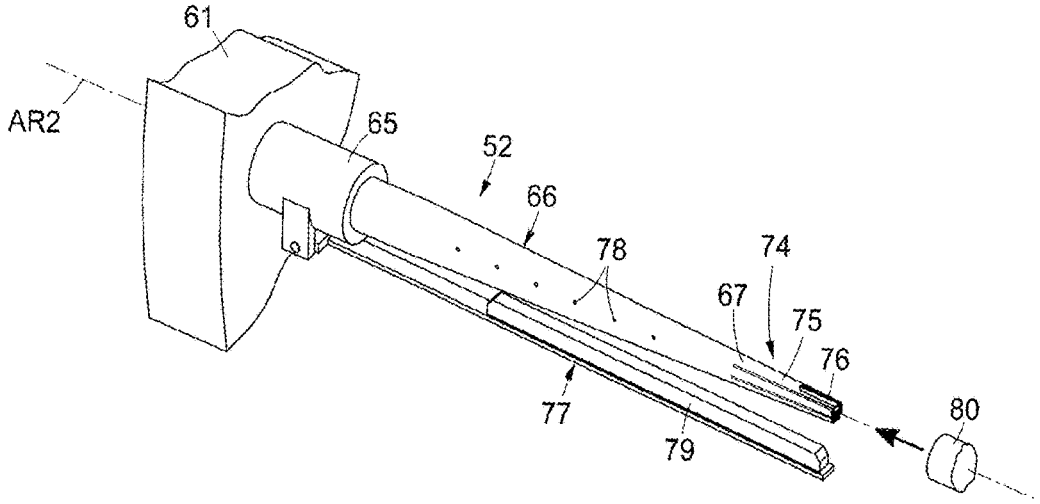
FIG. 7 is an enlarged perspective view of a detail of a second forming unit of the apparatus of FIG. 1, in which a second forming mandrel for forming a casing is shown.
Figure 11:
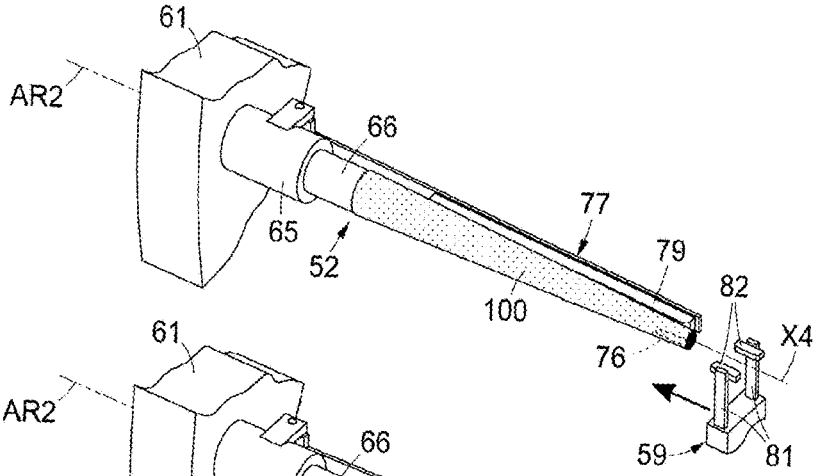
Figure 12:
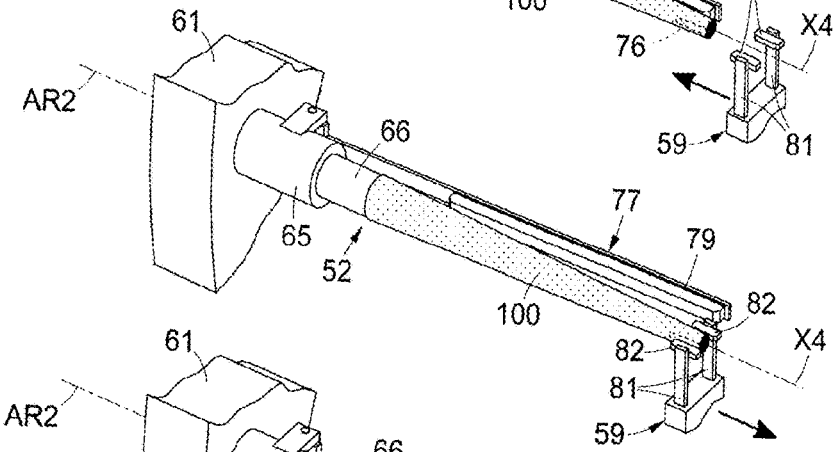
Figure 13:
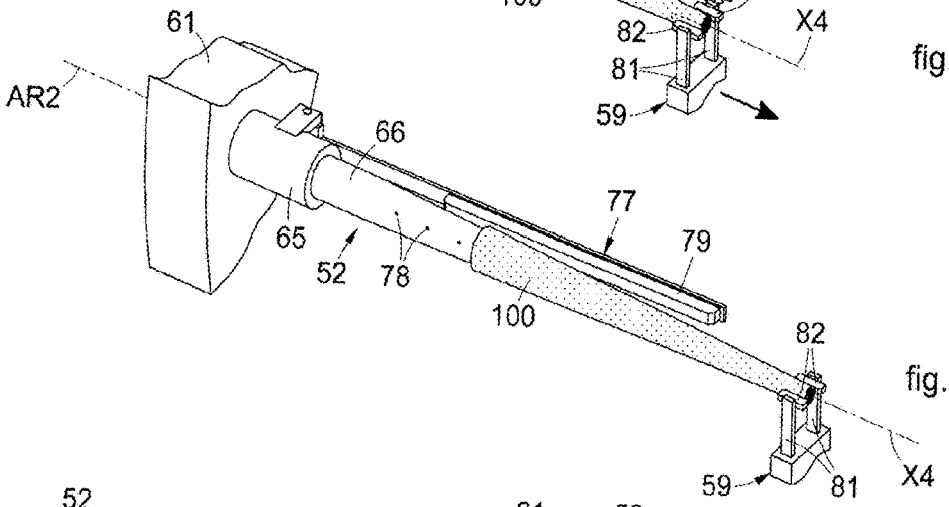
Figure 14:
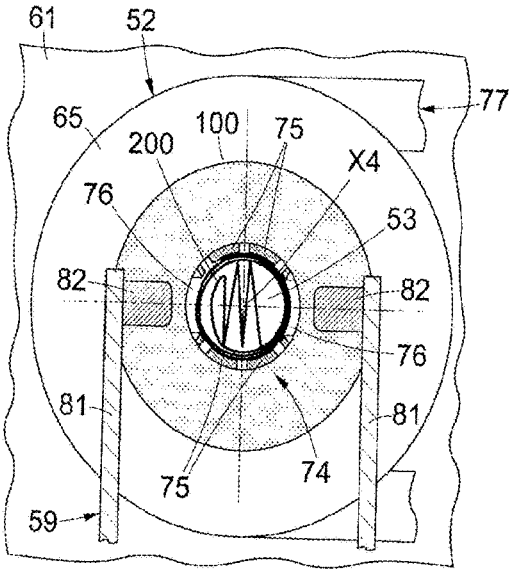
Figure 15:
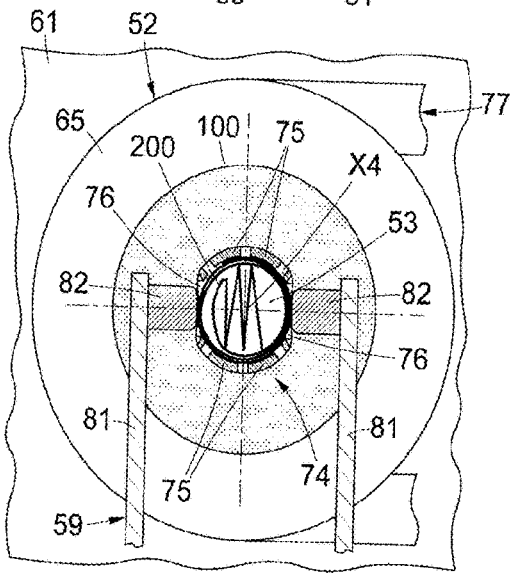

FIGS. from 8 to 10 are section lateral views of an operating sequence for inserting a filter inside the second forming mandrel of FIG. 7, by means of the first forming mandrel of FIG. 3;

FIGS. 11, 12 and 13 are perspective views of an operating sequence for extracting the casing including the filter;

FIGS. 14 and 15 are detailed views of the operating sequence shown in FIG. 12 and FIG. 13, respectively.

We must clarify that in the present description the phraseology and terminology used, as well as the figures in the attached drawings also as described, have the sole function of better illustrating and explaining the present invention, their function being to provide a non-limiting example of the invention itself, since the scope of protection is defined by the claims.

To facilitate comprehension, the same reference numbers have been used, where possible, to identify identical common elements in the drawings. It is understood that elements and characteristics of one embodiment can be conveniently combined or incorporated into other embodiments without further clarifications.

DESCRIPTION OF SOME EMBODIMENTS OF THE PRESENT INVENTION

Figure 1:
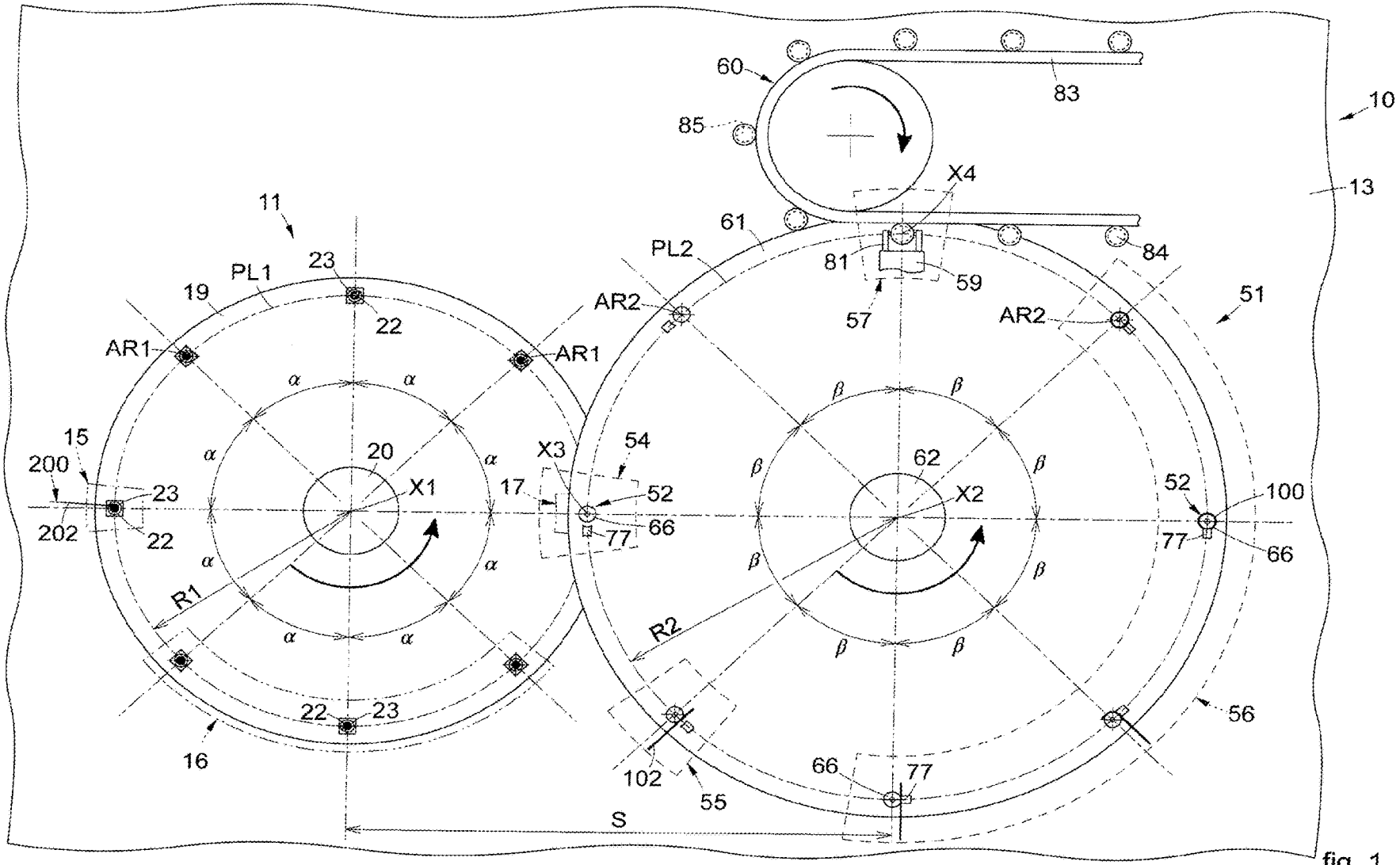
FIG. 1 is a schematic front view of an apparatus according to the present invention for automatically forming casings for smoking articles which include a filter.

With reference to FIG. 1, an apparatus 10 according to the present invention is suitable and usable to automatically form casings 100 for smoking articles, such as cigarettes or suchlike, including a filter 200.

In accordance with possible embodiments of the present invention, the apparatus 10 can be part of a more complex machine, not shown in the drawings, which can comprise other apparatuses for processing the casings 100 or the filters 200.

Before describing the apparatus 10 in detail, in order to better understand the present invention we will now describe the external casing 100 for smoking articles and the filter 200 which can be positioned inside the casing 100 in correspondence with a mouthpiece end 101 thereof.

The filter 200 can be made with a paper having a thickness greater than that of the casing 100, for example a few tenths of a millimeter. In particular, the filter 200 is obtained starting from a first shaped sheet 202 provided with a first part 203 having substantially a zig-zag folded shape and a second flat part 204 (FIG. 3).

The casing 100 can be made with a very thin and light paper, such as cigarette papers, having a thickness of a few hundredths of a millimeter. Each casing 100 is obtained from a second flat shaped sheet 102 (FIG. 1), which in turn is obtained in a known manner.

By way of example, the second shaped sheet 102 can be obtained as described in the Italian Patent Application filed in the name of the Applicant, to which the number 102021000032735 (IT'735) has been assigned.

The apparatus 10 (FIGS. 1 and 2) comprises at least a first forming unit 11 configured to form the filter 200 starting from the first shaped sheet 202 and a second forming unit 51 disposed downstream of the first forming unit 11 and configured to form the casing 100 starting from the second shaped sheet 102. The first forming unit 11 and the second forming unit 51 are mounted on a fixed support structure 13.

The first forming unit 11 comprises a plurality of operating zones, or stations, disposed in sequence along a first processing path PL1, among which at least:

- a first feeding zone 15, in which the first shaped sheets 202 coming from a feeding unit not shown in the drawings, of a known type or which will be developed in the future, are fed one at a time until they intercept the first processing path PL1;
- a first forming zone 16, in which one filter 200 at a time is formed starting from, that is using, a corresponding first shaped sheet 202, as indicated above;
- a transfer zone 17, in which one filter 200 at a time is transferred toward the second forming unit 51.

Preferably, the first processing path PL1 is closed in a ring and forms a circumference having a first radius R1. Specifically, the operating segment of the first processing path PL1 is substantially an arc of circumference. It is understood that in other embodiments, not shown in the drawings, the first processing path PL1 can be rectilinear, or have at least one rectilinear segment.

The first forming unit 12 comprises first movement means 20 which are configured to move the first forming mandrels 22 at least along the processing path PL1.

The movement means 20 comprise a first rotating disc-shaped member 19 which is disposed parallel to the support structure 13 and which lies on a first processing plane PW1. The first rotating member 19 is rotatable around a first main axis of rotation X1 and, in correspondence with its periphery, it defines the first processing path PL1, which is therefore coaxial to the first main axis of rotation X1. In the example given here, the first main axis of rotation X1 is horizontal and perpendicular to the support structure 13, and the first processing plane PW1 is perpendicular to the first main axis of rotation X1.

The rotation of the first rotating member 19 can occur both clockwise as well as also counterclockwise, with constant angular increments, or pitches α; this allows to perform several operations on the first shaped sheets 202 simultaneously, consequently increasing the overall productivity of the apparatus 10. Specifically, the rotation of the first rotating member 19 is obtained by means of first drive members, or devices, 18, for example by means of an electronically controlled stepper motor.

In the embodiment shown in FIG. 1, the angular pitch α is 45°, but it can also be different, that is, larger or smaller, depending on the design and construction choices of the apparatus 10.

Furthermore, the first rotating member 19 is provided with one or more first through holes 21 (FIG. 2, and from 8 to 10) made in determinate radial positions and angularly offset according to the same angular intervals α.

The first forming unit 11 comprises one or more first forming mandrels 22 (FIGS. 3, 4 and 5) rotatable around a first axis of rotation AR1 thereof in order to form the filter 200, and one or more abutment elements 23 disposed coaxially to the first axis of rotation AR1 in a fixed axial position with respect to the first forming mandrels 22.

Specifically, the abutment elements 23 are mounted on the first rotating member 19 coaxially to the first through holes 21 and the first forming mandrels 22 are each positioned inside a respective first through hole 21 so that at least a part thereof protrudes from the latter in order to cooperate with a corresponding abutment element 23, as will be described in detail below.

Figure 2:
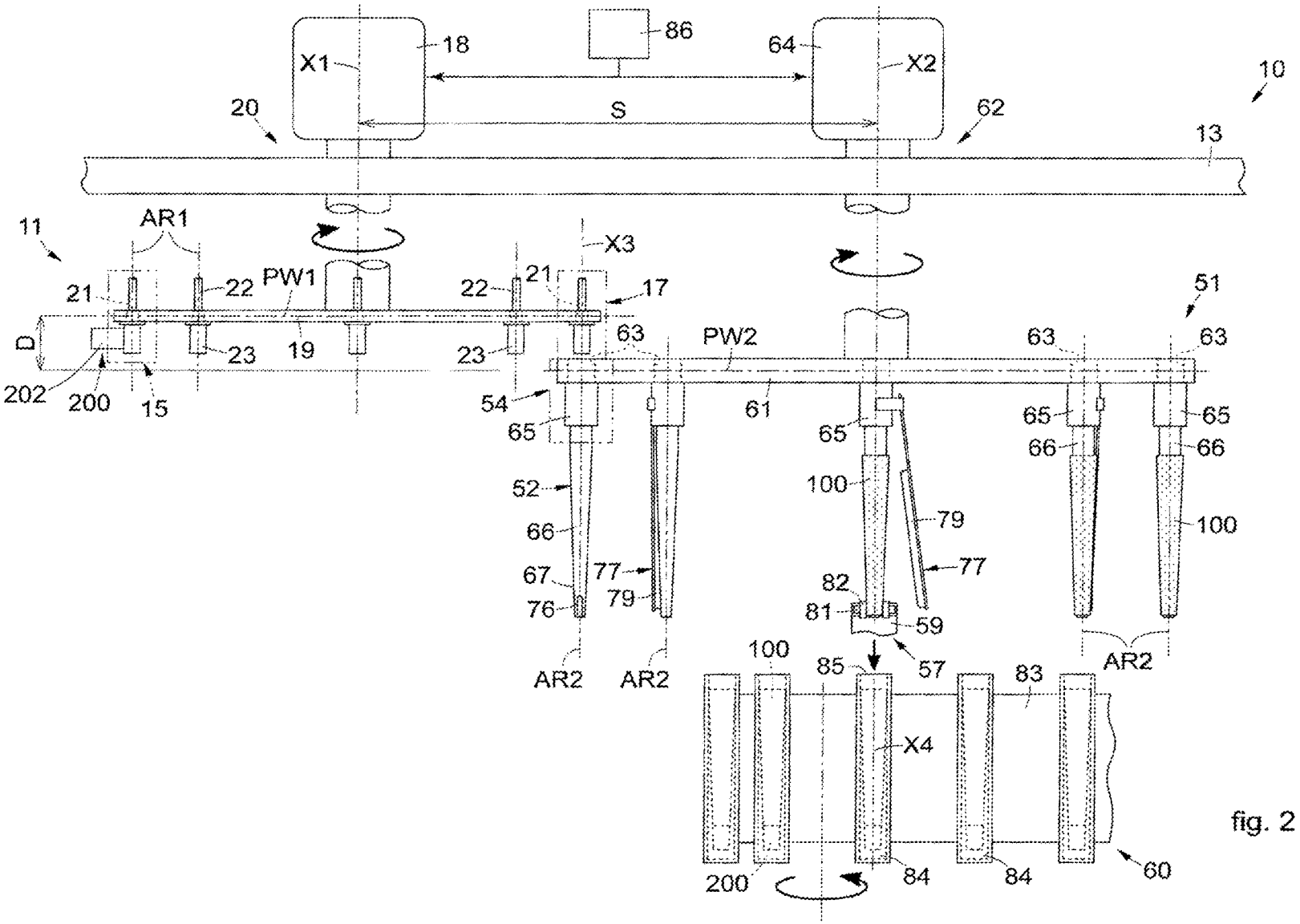
FIG. 2 is a top view of the apparatus of FIG. 1.

Please note that each first axis of rotation AR1 is parallel to the first main axis of rotation X1 of the rotating member 19 (FIG. 2).

In the example given here, the first through holes 21, the first forming mandrels 22 and the abutment elements 23 are eight (FIG. 1), since the angular intervals α are of 45°; it is clear that in other embodiments they can be in a number greater than or lower than eight, in any case chosen depending on the number of angular intervals α.

Figure 4:
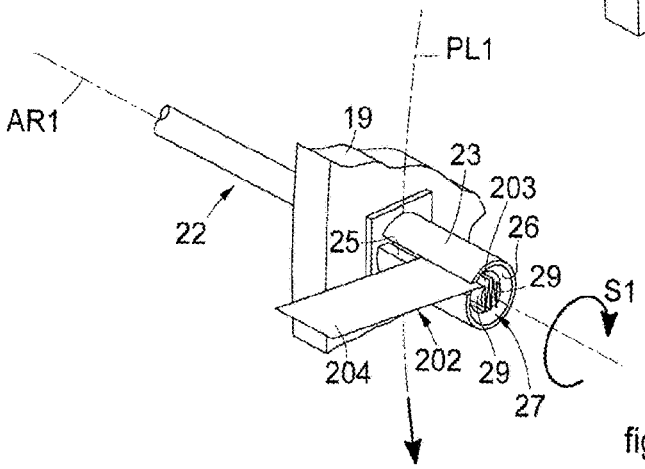
FIG. 4 is an enlarged perspective view of the detail of FIG. 3, in which the first forming mandrel of FIG. 3 is in a determinate operating condition.
Figure 5:
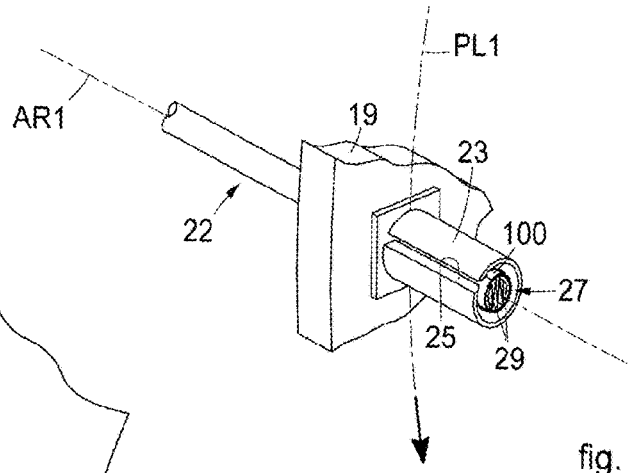
FIG. 5 is an enlarged perspective view of the detail of FIG. 3, in which the first forming mandrel of FIG. 3 is in another operating condition.
Figure 6:
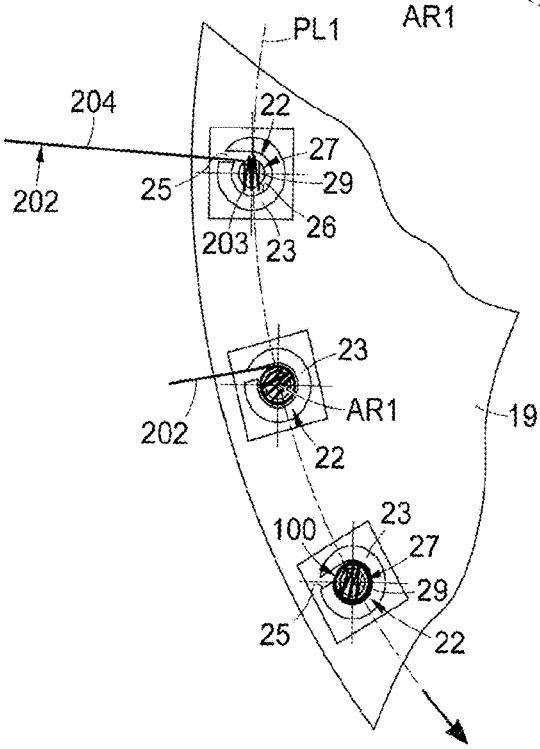
FIG. 6 is an operating sequence for forming a filter by means of the first forming unit of FIG. 1.

In accordance with the embodiment shown in FIGS. 3, 4 and 5, each abutment element 23 has a substantially tubular shape and comprises both a cylindrical through cavity 26, coaxial to the first axis of rotation AR1 and in which at least the first part 203 of the first shaped sheet 202 is insertable, and also at least one lateral slit 25, tangent to the cylindrical cavity 26 and having the function of allowing the passage of the second flat part 204 of the first shaped sheet 202.

In accordance with other embodiments of the present invention, not shown in the drawings, the abutment elements 23 can be different from those described and/or shown here; for example, they can be formed by two substantially semi-cylindrical portions and conformed in such a way as to allow the housing of the first shaped sheet 202.

The first forming mandrels 22 each comprise an oblong body provided, in correspondence with one end thereof, with holding means 27 for holding the first part 203.

As can be observed in FIGS. 4 and 5, along the first processing path PL1 each first forming mandrel 22 is disposed in a first operating position PO1, in which the respective holding means 27 are disposed inside the cylindrical cavity 26.

The holding means 27 (FIG. 3) comprise, or consist of, at least two gripping elements 29, for example jaws, which are opposite to each other with respect to the first axis of rotation AR1 and configured to hold the first part 203 inside the cylindrical cavity 26 (FIGS. 4 and 5). In particular, the two gripping elements 29 are fixed and distanced by a certain distance, such that they hold the first part 203 by interference.

In accordance with another embodiment, not shown in the drawings, the gripping elements 29 can be able to open and close selectively in order to hold and, respectively, release the first shaped sheet 202. Moreover, it is clear that according to other embodiments, other holding means 27 suitable to hold the first shaped sheet 202 can be used.

The first forming mandrels 22 are able to rotate independently around their first axis of rotation AR1 with respect to the rotation of the rotating member 19 around the first main axis of rotation X1. For example, during a single angular pitch α of the rotating member 19, each first forming mandrel 22 is able to perform one or more rotations of 360° around its first axis of rotation AR1, so as to wind the second part 204 around the first part 203, and thereby form the filter 200.

In accordance with another aspect of the present invention, each first forming mandrel 22 is also axially mobile along its own first axis of rotation AR1 between the first operating position PO1 and a second operating position PO2, in which it is in an advanced position to push and insert, by means of a roto-translational movement, the filter 200 in a corresponding second forming mandrel 52 of the second forming unit 51, in particular in a through axial cavity 53, or cavity 53, of the latter, as will be described in detail below.

We must clarify that the first movement means 20 are configured to also be able to selectively move each first forming mandrel 22 around and along its own first axis of rotation AR1; for example, the first movement means 20 can also comprise an epicyclic gearing and/or an electric or mechanical cam mechanism, of a known type and not shown in the drawings, associated with each first forming mandrel 22.

The second forming unit 51 (FIGS. 1 and 2) comprises a plurality of operating zones, or stations, disposed in sequence along a second processing path PL2, among which at least:

- an insertion zone 54, in which one filter 200 at a time is inserted by means of the first forming mandrel 22 into the cavity 53 of a corresponding second forming mandrel 52;
- a second feeding zone 55, in which the second shaped sheets 102 are fed one at a time until they intercept the second processing path PL2;

a second forming zone 56, in which one casing 100 at a time is formed, with the filter 200 inside it, starting from, that is, using, a corresponding second shaped sheet 102;

an extraction zone 57, in which, by means of an extraction device 59, each casing 100 including a filter 200 is extracted and disposed on a transfer device 60, positioned downstream of the second forming unit 51.

Preferably, the second processing path PL2 is closed in a ring and forms a circumference having a second radius R2. Specifically, the operating segment of the second processing path PL2 is substantially an arc of circumference. It is understood that in other embodiments, not shown in the drawings, the second processing path PL2 can be rectilinear, or have at least one rectilinear segment.

The second forming unit 51 comprises second movement means 62 which are configured to move the second forming mandrels 52 at least along the second processing path PL2.

The second movement means 62 comprise a second disc-shaped rotating member 61 which is disposed parallel to the support structure 13 and which lies on a second processing plane PW2. The second rotating member 61 is rotatable around a second main axis of rotation X2, parallel to the first main axis of rotation X1, and, in correspondence with its periphery, it defines the second processing path PL2, which is therefore coaxial to the second main axis of rotation X2.

The first and second processing plane PW1 and PW2 are parallel to each other and distanced so as not to interfere with each other.

In particular, the sum of the first radius R1 and the second radius R2 is equal to the longitudinal distance, or distance S between centers, between the first and the second axis of rotation X1 and X2, whereby the processing paths PL1 and PL2, in correspondence with the respective transfer 17 and insertion 54 zones, are tangent to a common axis of insertion X3.

The axis of insertion X3 is parallel to the first and second axis of rotation X1 and X2, and along it the first and second forming mandrel 22 and 52 are temporarily aligned with each other for the correct insertion of the filter 200 inside the cavity 53. Please note that, when the first and second forming mandrel 22 and 52 are aligned along the axis of insertion X3, the respective axes of rotation AR1 and AR2 lie on the same axis of insertion X3.

The rotation of the second rotating member 61 can occur clockwise with constant angular increments, or β; this allows to perform several operations on the second shaped sheets 102 simultaneously, consequently increasing the overall productivity of the apparatus 10.

In the example given here, the angular pitches β are the same as the angular pitches α and the angular speeds of the first and second rotating member 19 and 61 are the same as each other, so as to synchronize their rotations in order to guarantee the correct alignment along the axis of insertion X3 of the first and second forming mandrel 22 and 52.

It is understood that according to other embodiments, not shown in the drawings, the angular pitches β and α can be different from each other and the angular speeds of rotation are such as to allow the synchronization of the rotations of the first and second rotating member 19 and 61.

The rotation of the second rotating member 61 is obtained by means of second drive members, or devices, 64 (FIGS. 1 and 2), which can be of any known type, and which may comprise, for example, an electronically controlled stepper motor.

The second rotating member 61 is provided with one or more second through holes 63 (FIG. 2, and from 8 to 10) made in determinate radial positions and angularly offset according to the same angular intervals β. In the example given here, since the angular intervals β are of 45°, there are eight second through holes 63 (FIG. 1).

The second forming unit 51 comprises one or more second forming mandrels 52 (FIG. 7) rotatable around a second axis of rotation AR2 thereof to form the casing 100.

The second forming mandrels 52 are mounted on the second rotating member 61 in correspondence with the corresponding second through holes 63 and each second axis of rotation AR2 is parallel to the second main axis of rotation X2.

We must clarify that the second movement means 62 (FIGS. 1 and 2) are configured to also be able to selectively make each second forming mandrel 52 rotate around its own second axis of rotation AR2; for example, the second movement means 62 can also comprise an epicyclic gearing and/or an electric or mechanical cam mechanism, of a known type and not shown in the drawings, associated with each second forming mandrel 52.

Each second forming mandrel 52 is configured to be wrapped, on an external surface thereof, by the second shaped sheet 202, so as to create the casing 100.

Specifically, each second forming mandrel 52 (FIGS. from 7 to 10) comprises both a support part 65 having a cylindrical shape and configured to be associated with the second rotating member 61, and also a central forming part 66 substantially having an external peripheral surface with a truncated cone, or possibly cylindrical, shape, which negatively reproduces the shape of the casing 100 to be made and which is configured to cooperate with the second shaped sheet 102 in order to form the casing 100.

The forming part 66 comprises a first end 67 opposite the support part 65 and corresponding to the mouthpiece end 101 of the casing 100, and a second end 69 which substantially corresponds to the ignition end of the casing 100 and which is associated with the support part 65. As shown in FIG. 7, if the forming part 66 has a truncated cone shape, the first end 67 has a smaller diameter than the second end 69.

Each second forming mandrel 52 is internally provided with the through axial cavity 53 (FIGS. from 8 to 10), which comprises an inlet aperture 71 in communication with the respective second through hole 63 for the insertion of the filter 200, and an outlet aperture 72, opposite the inlet aperture 71 and associated with the first end 67, to allow the extraction of the filter 200 together with the casing 100.

In particular, the cavity 53 has a section such as to allow the passage of the first forming mandrel 22, and it is configured to accommodate, at least temporarily, the filter 200 in correspondence with the first end 67.

The second forming mandrel 52 comprises respective elastic and flexible holding means 74 configured to elastically hold the filter 200 when it is inserted in the cavity 53 in correspondence with the first end 67.

According to the embodiments shown here, the first end 67, the respective holding means 74 comprise two or more elastic and flexible foils 75 for elastically holding the filter 200 when it is inserted in the cavity 53. Preferably, the foils 75 are four and have a length greater than the length of the filter 200.

In addition, the first end 67 is provided with two slots 76 made on corresponding foils 75 in diametrically opposite positions with respect to the second axis of rotation AR2 and connected to the outlet aperture 72. Specifically, the two slots 76 have the function of leaving two corresponding parts of the filter 200 exposed, for the extraction thereof by means of the extraction device 59, as will be described in detail below.

Each second forming mandrel 52 is also provided with at least one holding member 77 (FIG. 7) disposed externally to the central forming part 66 and constrained, at one end, to the support part 65.

In particular, the holding member 77 comprises a jaw 79 which can be selectively driven to temporarily hold a respective second shaped sheet 102 against the peripheral surface of the central forming part 66 (FIG. 1). The selective opening and closing of the jaw 79 is obtained, for example, by means of a dedicated actuator, not shown in the drawings.

Moreover, on the peripheral surface of the central forming part 66 there can be a plurality of suction holes 78 operatively connected to suction means, not shown in the drawings, and having the function of selectively holding one second shaped sheet 102 at a time against the peripheral surface of the central forming part 66 during the formation of the casing 100.

The second forming unit 51, in correspondence with the insertion zone 54, comprises an abutment member 80 having, for example, the shape of a bushing and configured to selectively cooperate with the foils 75 of each second forming mandrel 52, both in order to define an axial end-of-travel point for the filter 200 in the cavity 53, and also to limit the radial expansion of the foils 75 when the filter 200 is inserted inside the cavity 53.

By way of example, the feeding zone 55 of the second shaped sheets 102 and the forming zone 56 of the casings 100 may be as those described in the aforementioned Patent Application IT'735, therefore they will not be described and shown in detail.

In addition, in correspondence with the extraction zone 57, the apparatus 10 comprises the extraction device 59, which has the function of extracting the casing 100 including the filter 200 from the second forming mandrel 52, by means of a translational movement along an axis of extraction X4, in order to transfer it to the transfer device 60. The axis of extraction X4 is parallel and aligned to the second main axis of rotation X2.

The extraction device 59 is shaped and configured to contact the casing 100 by gripping the filter 200.

The extraction device 59 comprises two selectively closable jaws 81 for gripping the casing 100, including the filter 200, in a controlled manner, in correspondence with the corresponding mouthpiece end 101. Specifically, the jaws 81 are provided with respective gripping elements 82 opposed to each other and shaped in such a way as to be inserted between the foils 75, that is, in the slots 76, in order to contact the casing 100 and also grip the filter 200, to extract them together with the translational movement.

Preferably, the gripping elements 82 can be coated with a material having a roughness greater than that of the paper with which the casing 100 is made so as to generate a frictional force such as to prevent slipping between the contact surfaces of the gripping plugs 82 and of the casing 100.

The transfer device 60 has the function of transferring each casing 100 provided with filter 200 toward a processing apparatus, or zone, not shown in the drawings. In the example given here, the transfer device 60 comprises, or consists of, a conveyor belt 83 having a plurality of tubular seatings 84 which define the housing seatings for each casing 100 including a filter 200.

Each tubular seating 84 is provided with an aperture 85 facing toward the second rotating member 61 to allow the insertion of the casing 100 including a filter 200. Please note that the rotation speeds of the second rotating member 61 and of the transfer device 60 are such as to synchronize the movement of the latter, in order to allow the correct transfer of the casing 100 including a filter 200 from the extraction zone 57 to a respective tubular seating 84 by means of the extraction device 59.

In addition, to facilitate the insertion of each casing 100 including a filter 200 into the tubular seating 84, there may also be guide or holding means associated with the latter, of a known type or which will be created in the future and not shown in the drawings. In addition, an actuation member, such as a linear actuator, can also be provided that acts from inside the second forming mandrel 52 to facilitate the insertion of the casing 100 including a filter 200 into the tubular seating 84.

In accordance with another aspect of the present invention, the apparatus 10 comprises a central control unit 86 (FIG. 2) programmed to control and command the drive of the movement means 20 and 62 so as to synchronize the rotations of the rotating members 19 and 61 and the movements of the first and second forming mandrels 22 and 52. In addition, the central control unit 86 is programmed to also command the drive of the extraction device 59 and of the transfer device 60 in relation to the rotation of the second rotating member 61.

The operation of the apparatus 10 described heretofore, which corresponds to the method according to the present invention, comprises the following steps.

We must clarify that what will be described for a single first shaped sheet 202 and for a single second shaped sheet 102 will be valid cyclically for each of the first shaped sheets 202 and the second shaped sheets 102 with which the filters 200 and, respectively, the casings 100 are obtained.

In an initial preparation step, the central control unit 86 is programmed to control and coordinate the drive of the first and second movement means 20 and 62, the extraction device 59 and the transfer device 60.

The method comprises a step of feeding the first shaped sheets 202 toward the first feeding zone 15, in which, by means of an insertion member 87, each first shaped sheet 202 is inserted head-on, that is, frontally, into the cylindrical cavity 26 of the abutment element 23 so that its first part 203 is interlocked and is held at least by interference between the gripping elements 29 of the holding means 27, and its second part 204 is positioned in the corresponding lateral slit 25.

Subsequently, while the rotating member 19 rotates around its first main axis of rotation X1 to take the first shaped sheet 202 toward the transfer zone 17, in a step of forming the filter 200, the first forming mandrel 22 rotates around its first axis of rotation AR1 with a first direction of rotation S1 and by cooperating with the corresponding abutment element 23, in particular with the cylindrical cavity 26, it wraps the second part 204 of the first shaped sheet 202 around the first part 203 and the gripping elements 29, forming the filter 200. Please note that both in the step of feeding the first shaped sheets 202, and also in the step of forming the filter 200, the first forming mandrel 22 is in the first operating position PO1.

Once the filter 200 is formed, a step of pushing the filter 200 into the cavity 53 by means of the first forming mandrel 22 is performed in correspondence with the transfer zone 17. Specifically, the first forming mandrel 22, passing from the first operating position PO1 to the second operating position PO2, pushes and then inserts one filter 200 at a time inside the cavity 53 of a corresponding second forming mandrel 52, which is aligned with the first forming mandrel 22 along the axis of insertion X3.

Figure 8:
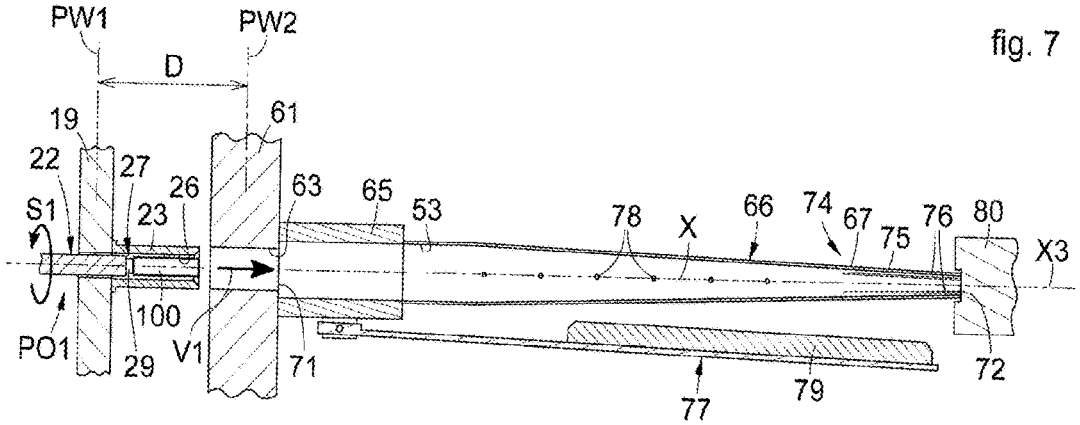
Figure 9:
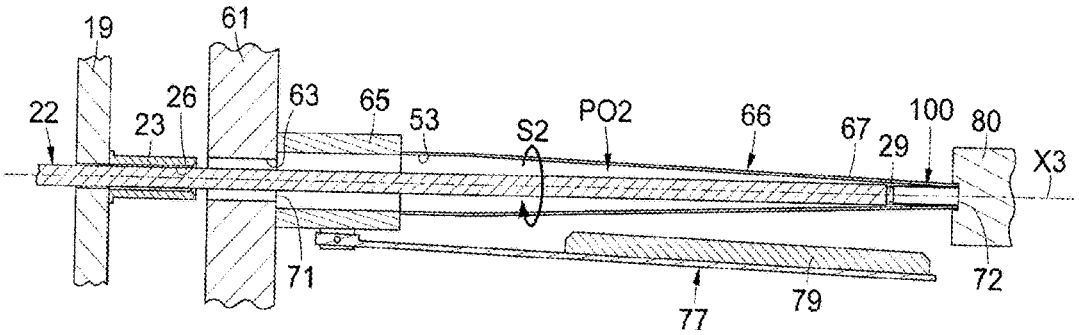
Figure 10:
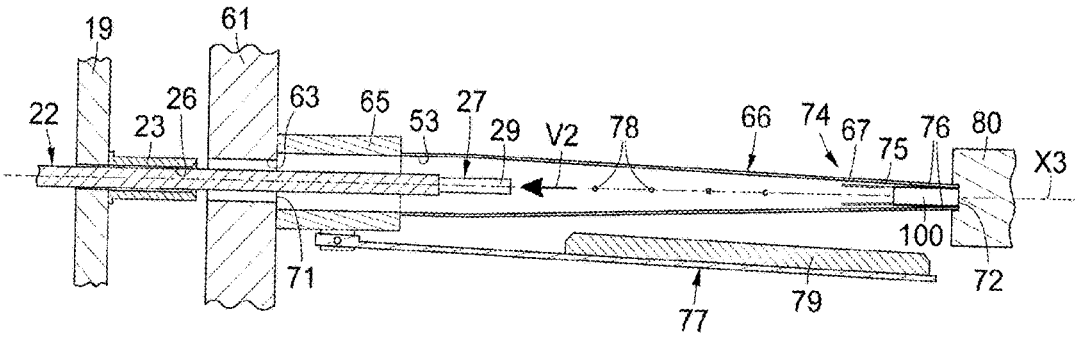

In particular, the step of Pushing the Filter 200 Comprises the Following operating sub-steps:

- a first translation sub-step, in which the first forming mandrel 22, from a first operating position PO1, advances along its first axis of rotation AR1, that is, along the axis of insertion X3, with a first speed V1 and enters inside the cavity 53 through the inlet aperture 71 in order to reach the second operating position PO2 (FIG. 8);
- a first insertion sub-step, in which, during the advance, the first forming mandrel 22 rotates around its first axis of rotation AR1 in the first direction of rotation S1, giving the filter 200 a helical movement to facilitate its insertion inside the cavity 53;
- a second insertion sub-step, in which when the first forming mandrel 22 arrives in correspondence with the foils 75, that is, before reaching the second operating position PO2, it reverses its direction of rotation by a few degrees, passing to a second direction of rotation S2 different from the first direction of rotation S1, in order to release the latter inside the cavity 53 in correspondence with the first end 67, therefore upon arriving at the second operating position PO2 (FIG. 9); and
- a second translation sub-step, in which the first forming mandrel 22, from the second operating position PO2, moves back along the axis of insertion X3 with a second speed V2 that is much higher than the first speed V1, for example it can be about one or two orders of magnitude higher, thus completing the release of the filter 200 inside the cavity 53, to then return to the first operating position PO1 (FIG. 10).

Please note that in the step of pushing the filter 200, the latter is pushed by the first forming mandrel 22 until it partly comes out of a first end 67 of the second forming mandrel 52, and without making it come out of the casing 100.

Once the insertion has ended, the filter 200 is inside the second forming mandrel 52 and the first forming mandrel 22 is in the first operating position PO1.

We must clarify that during the step of pushing the filter 200, the abutment member 80 is positioned in contact with the first end 67 (FIG. 8) so as to cooperate with it both to close the outlet aperture 72, thereby defining an end-of-travel for the filter 200, and also to limit the expansion of the foils 75 when the filter 200 is inserted in correspondence therewith (FIGS. 9 and 10). Once the insertion of the filter 200 has ended, the abutment member 80 is distanced from the second forming mandrel 52 to allow it to be transported by the rotating member 61.

Then, the second rotating member 61 rotates around its second main axis of rotation X2 and takes the second forming mandrel 52 with the filter 200 inside it from the insertion zone 54 to the feeding zone 55 of the second shaped sheets 102. Please note that during the step of pushing the filter 200, the holding member 77 of the second forming mandrel 52 is in an open condition.

Then, the method comprises a step of feeding a second shaped sheet 102 and delivering it to the second forming mandrel 52. For example, the feed and delivery of the second shaped sheets 102 can be performed as described in Patent Application IT'735.

Subsequently, in correspondence with the second forming zone 56 the step of forming the casing 100 is performed by means of the corresponding second forming mandrel 52, inside which the filter 200 is present. For example, the forming of the casing 100 can be performed as described in the Patent Application IT'735.

Once the casing 100 has been formed, the second rotating member 61 rotates once again around the second main rotation axis X2, taking the second forming mandrel 52 provided externally with the casing 100 and internally with the filter 200, in correspondence with the extraction zone 57.

Then, the step of simultaneously extracting both the casing 100 and also the filter 200 from the second forming mandrel 52 by means of the extraction device 59 is performed. In particular, in this step the extraction device 59 approaches the second forming mandrel 52, positioning the jaws 81 in correspondence with the slots 76 (FIG. 11). The jaws 81 are then tightened so that the gripping plugs 82 contact the casing 100 and enter between the slots 76 in order to also grip the filter 200 (FIG. 12). Then, as shown in FIG. 13, with a translational movement along the axis of extraction X4, the casing 100 including a filter 200 is extracted in order to transfer it and consequently insert it inside a corresponding tubular seating 84 of the transfer device 60.

Finally, in a final transport step, the transfer device 60 transports the casings 100 including a filter 200 toward another processing zone or unit, not shown in the drawings.

It is clear that modifications and/or additions of parts may be made to the apparatus 10 and to the method as described heretofore, without departing from the field and scope of the present invention, as defined by the claims.

It is also clear that, although the present invention has been described with reference to some specific examples, a person of skill in the art will be able to achieve other equivalent forms of apparatuses for automatically forming a casing for smoking articles including a filter, having the characteristics as set forth in the claims and hence all coming within the field of protection defined thereby.

In the following claims, the sole purpose of the references in brackets is to facilitate their reading and they must not be considered as restrictive factors with regard to the field of protection defined by the very claims.

The invention claimed is:

1. Apparatus for automatically forming a casing with filter for smoking articles, said apparatus comprising a first forming unit configured to form said filter starting from a first sheet, and a second forming unit configured to form said casing starting from a second sheet, wherein said first forming unit comprises at least one first forming mandrel rotatable around a first axis of rotation thereof to form said filter and axially mobile along said first axis of rotation, said first forming mandrel being provided with holding means to hold at least a first part of said first sheet, and wherein said second forming unit comprises at least one second forming mandrel configured to be wrapped on an external surface thereof by said second sheet so as to create said casing, wherein said second forming mandrel is provided internally with a through axial cavity, and in that said at least one first forming mandrel is configured to push said filter along said through axial cavity by means of a roto-translational movement around and along said first axis of rotation when said second forming mandrel, with the second sheet wrapped on its external surface, is aligned with said first forming mandrel along a common axis of insertion.

2. Apparatus as in claim 1, wherein said first forming unit comprises at least one abutment element disposed coaxially to said first axis of rotation in a fixed axial position with respect to said first forming mandrel and operatively associated with said holding means.

3. Apparatus as in claim 2, wherein said abutment element comprises both a through cylindrical cavity, coaxial to said first axis of rotation and in which said holding means and at least said first part of said first sheet are able to be inserted, and also a lateral slit, tangent to said cylindrical cavity, to allow the passage of a second flat part of said first sheet.

4. Apparatus as in claim 3, wherein said second forming mandrel has a substantially truncated cone shape.

5. Apparatus as in claim 1, wherein said first forming unit comprises first movement means configured to move said at least one first forming mandrel both around and along its first axis of rotation, and also along a first processing path which comprises at least a first forming zone of said filter and a transfer zone of said filter, distant from said first forming zone.

6. Apparatus as in claim 5, wherein said first movement means comprise at least a first rotating member which is rotatable around a first main axis of rotation, parallel to said first axis of rotation, said first processing path being substantially a circumference arc coaxial to said first main axis of rotation and having a first radius.

7. Apparatus as in claim 6, wherein said second forming unit comprises second movement means configured to move said at least one second forming mandrel at least along a second processing path which comprises at least an insertion zone of said filter into said through axial cavity, and an extraction zone of said casing including said filter from said second forming mandrel.

8. Apparatus as in claim 7, wherein said second movement means comprise a second rotating member which is rotatable around a second main axis of rotation parallel to said first main axis of rotation, said second processing path being substantially a circumference arc coaxial to said second main axis of rotation and having a second radius, and in that said first and second processing path, in correspondence with the transfer and insertion zone, respectively, are tangent to said common axis of insertion, which is parallel to said first and second main axis of rotation and along which said first and second forming mandrels are temporarily aligned with each other.

9. Apparatus as in claim 1, wherein said at least one second forming mandrel comprises respective elastic and flexible holding means configured to elastically hold said filter when it is inserted in said cavity in correspondence with a first end.

10. Apparatus as in claim 9, wherein said second forming unit comprises an abutment member configured to cooperate selectively with said respective holding means, both in order to define an axial end-of-travel point for said filter in said cavity, and also to limit the expansion of said respective holding means when said filter is inserted in said through axial cavity.

11. Apparatus as in claim 1, wherein said second forming unit also comprises an extraction device shaped and configured to contact said casing by gripping said filter, so as to extract from said second forming mandrel said casing including said filter by means of a translational movement along an axis of extraction.

12. Apparatus as in claim 1, wherein said second forming unit also comprises at least one holding member configured to temporarily hold said second sheet against the external surface of said second forming mandrel.

13. Method for forming a casing with a filter for smoking articles, said method comprising:

forming said filter starting from a first sheet by means of at least one first forming mandrel rotatable around a first axis of rotation thereof;

holding, by means of holding means, at least a first part of said first sheet on said first forming mandrel;

wrapping a second sheet around an external surface of at least one second forming mandrel, so as to create said casing;

positioning said first forming mandrel with said filter held by said holding means, and said second forming mandrel with the second sheet wrapped on its external surface, in alignment with each other along a common axis of insertion; and pushing, by means of said first forming mandrel, said filter along a through axial cavity created inside said second forming mandrel, performing a roto-translational movement around and along said first axis of rotation.

14. Method as in claim 13, wherein in said step of forming the filter said at least one first forming mandrel cooperates with a corresponding abutment element, which is in a fixed axial position, in order to form said filter, wherein said at least one first forming mandrel, by means of said holding means, holds said first part in a cylindrical cavity of said abutment element, while a second part of said first sheet is disposed in a lateral slit of said abutment element, and wherein said at least one first forming mandrel, by rotating around said first axis of rotation, cooperates with said cylindrical cavity in order to wrap said second part around said first part, thus forming said filter before pushing it into the through axial cavity.

15. Method as in claim 13, wherein said step of pushing the filter comprising:

a first translation sub-step, in which said first forming mandrel, from a first operating position, advances along said axis of insertion with a first speed and enters said through axial cavity in order to reach a second operating position;

a first insertion sub-step, in which, during the advance, said first forming mandrel rotates around its first axis of rotation in a first direction of rotation, giving said filter a helical movement in order to facilitate its insertion inside said through axial cavity;

a second insertion sub-step, in which said first forming mandrel, before reaching said second operating position, reverses the direction of rotation; and a second translation sub-step, in which said first forming mandrel, from said second operating position, moves back along said axis of insertion with a second speed, greater than said first speed, in order to return to said first operating position.

16. Method as in any claim from 13, wherein it comprises a step of extracting both said casing and also said filter from said second forming mandrel by means of a translational movement, along an axis of extraction, of an extraction device.

17. Method as in claim 13, wherein in said step of pushing the filter, the latter is pushed by the first forming mandrel until it partly comes out of a first end of said second forming mandrel, and without making it come out of said casing.

* * * * *